United States Patent [19]

Hardison

[11] Patent Number: 4,856,792

[45] Date of Patent: Aug. 15, 1989

[54] ARCHERS ARROW WITH CHEMICAL LIGHT SOURCE

[76] Inventor: Philip M. Hardison, Rte. 1, Box 262, Plymouth, N.C. 27962

[21] Appl. No.: 276,547

[22] Filed: Nov. 28, 1988

[51] Int. Cl.[4] ..... F41B 5/02

[52] U.S. Cl. ..... 273/416; 362/34

[58] Field of Search ..... 273/416; 362/34, 191; 446/47, 219

[56] References Cited

U.S. PATENT DOCUMENTS

| | | | |
|---|---|---|---|
| 1,438,839 | 12/1922 | Levey | 362/34 X |
| 3,875,602 | 4/1975 | Miron | 362/34 X |
| 4,086,723 | 5/1978 | Strawick | 446/47 |
| 4,106,079 | 8/1978 | Drury | 362/34 |
| 4,207,702 | 6/1980 | Boatman et al. | 446/219 X |
| 4,255,895 | 3/1981 | La Brecque | 446/47 |
| 4,340,930 | 7/1982 | Carissimi | 273/416 X |

*Primary Examiner*—Paul E. Shapiro

[57] ABSTRACT

The present invention relates to an archer's arrow having a chemical light source for locating the arrow after flight.

2 Claims, 2 Drawing Sheets

ARCHERS ARROW WITH CHEMICAL LIGHT SOURCE

FIELD OF THE INVENTION

The present invention relates to an archers arrow, and in particular, to an archers arrow having a chemical light source for locating the arrow after flight.

BACKGROUND OF THE INVENTION

It is often difficult to locate an arrow after it has been shot from a bow. During hunting when an arrow misses its mark, it may land in dense bush, leaves, or the like, making it difficult to locate. When an arrow becomes embedded in an animal, it will often travel a distance before falling, sometimes in dense brush. The above situations are more pronounced at or about dusk. Accordingly, there has been a long felt need for a simple device to assist hunters in locating missing arrows and animals with embedded arrows.

Previous disclosures have related to audible signals and to electrical light signals as a means for locating arrows. U.S. Pat. Nos. 4,340,930 and 4,547,837 disclose electrical light means for locating arrows. These devices require batteries, bulks, switches, and the like. Since these have weight, they may affect the flight of the arrow. U.S. Pat. No. 4,421,319 discloses an audible signal means for locating arrows.

The disclosure relates to a chemical light source. Since the device does not add additional weight to the arrow, there is negligible affect on flight.

SUMMARY OF THE INVENTION

In summary, the present invention relates to the use of a chemical lightstick as a chemical light source for locating arrows. The lightstick is inserted into a cavity in a transparent plastic arrow nock. The chemical light source does not require batteries, bulbs, and circuits, therefore, it does not have the weight factor and less affect on arrow accuracy.

Accordingly, an object of the present invention is to provide an archer's arrow with chemical light source for locating the arrow after flight.

A further object of the present invention is to provide an arrow with nock having cavity with dimensions designed to accept commercially available lightsticks.

These and other objects will be seen from the following specification and claims in conjunction with the drawings.

DETAILED DESCRIPTION OF THE INVENTION

Figure 1:
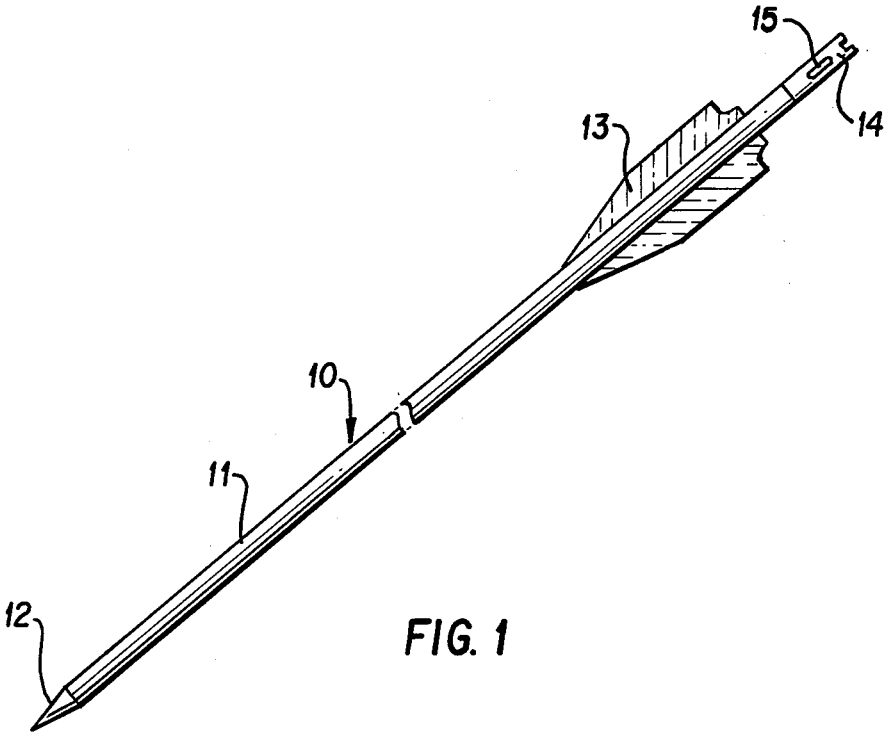
FIG. 1 is a perspective view of the present arrow having chemical light means incorporated therein.

Referring to the drawings, FIG. 1 illustrates an arrow of the present invention, generally designated (10), including an elongated shaft (11) having a point end (12) for penetrating the target, fetching (13) for controlling the flight, and nock (14) attached at the rear of shaft (11). Nock (14) has cavity (15) for insertion of lightstick (16).

Arrow nocks are well known in the prior art. They are typically made of a solid plastic body, being attached at one end to an arrow shaft and having at the other end a notch to receive the bow string. In the present invention, nock (14) has cavity (15) for inserting a lightstick (16). The activated lightstick provides a constant light emission to assist the archer in locating the arrow (10) after it has been shot.

Figure 2:
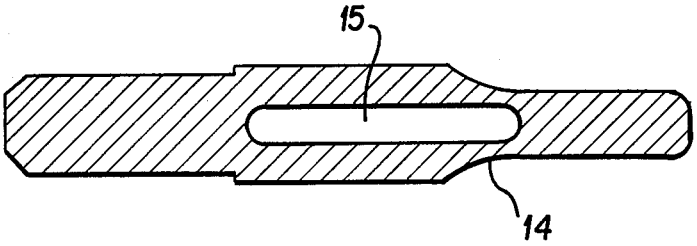
FIG. 2 is a sectional view of the nock detached from the arrow shaft.

Referring to FIG. 2, there is shown a cross-sectional view of nock (14) of this invention, the nock being detached from the arrow shaft (11). The body of nock (14) has cavity (15) for insertion of a lightstick. In a preferred embodiment, the nock is made of polycarbonate resin, but other plastic resins are suitable.

Figure 3:
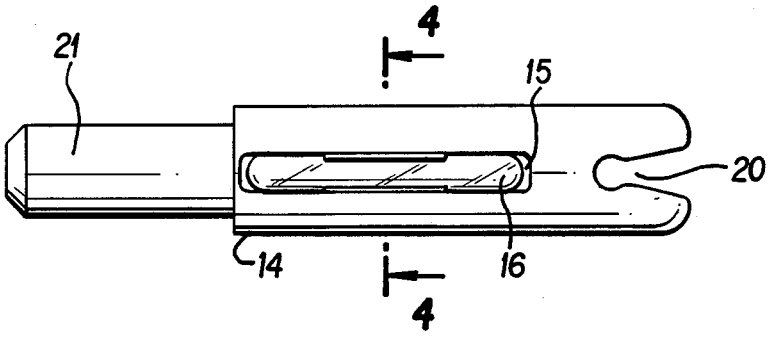
FIG. 3 is a perspective view of nock with lightstick being inserted.

Referring to FIG. 3, there is shown nock (14) having cavity (15) with lightstick 16) inserted. Arrow-nock insert (21) connects nock (14) to arrow shaft (11). In a preferred embodiment, insert (21) is glued to shaft (11) for connecting nock to shaft. This connection could also be by screw means.

Figure 4:
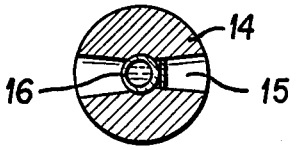
FIG. 4 is an end view, in cross-section of nock taken at 4—4 of FIG. 3.
Figure 5:
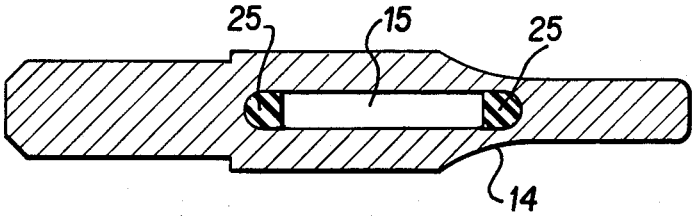
FIG. 5 is a side view, in cross section of the nock showing backstops.

FIG. 4 is an end cross-section view of nock (14) taken at 4—4 of FIG. 3. There is shown cavity (15) with lightstick (16) being inserted. Note that interior wall of nock (14) has concave design at point where wall of nock (16) rest. This design holds lightstick (16) in place in cavity (15) during flight. In an alternate embodiment seen in FIG. 5, there is provided backstop (25) for retaining ends of lightstick (16) thereby holding lightstick in place during flight.

Lightsticks are commercially available, CYALUME®being an example. Light emission is provided by a chemical reaction which takes place when two solutions are mixed. Typically, one of the solutions is stored in a very thin ampule which is broken by bending to activate the lightstick. Lightsticks emit light only, they are not a source of heat or spark making them safe and suitable for use in the woods.

In a preferred embodiment, the cavity (15) is designed to accommodate a lightstick (16) having dimensions of 24 mm×2.9 mm. During use, the archer activates the lightstick (16) just before arrow use and inserts it into cavity (15). Typically, a lightstick will emit light for several hours. The constant light emission aids the archer in locating the arrow after flight.

What is claimed is:

1. An archer's arrow having a chemical light source, comprising:

(a) an elongated body forming arrow shaft, said shaft having sharp point and fletching;

(b) a plastic body forming nock, having at one end an insert for attaching to said shaft, and at other end a notch to receive a bow string, said nock having a cavity in main body; and (c) a chemical lightstick inserted in said cavity of said nock for light emission;

(e) two backstop plates located off center at each end of said cavity for retaining said lightstick.

2. An archer's arrow as recited in claim 1 wherein said nock is made of transparent plastic material.

* * * * *